United States Patent [19]

Faul et al.

[11] 4,035,184

[45] July 12, 1977

[54] METHOD OF PRODUCING REVERSAL COLOR IMAGES

[75] Inventors: William H. Faul; Patrick H. Saturno, both of Rochester, N.Y.

[73] Assignee: Eastman Kodak Company, Rochester, N.Y.

[21] Appl. No.: 658,329

[22] Filed: Feb. 17, 1976

Related U.S. Application Data

[63] Continuation-in-part of Ser. No. 487,085, July 10, 1974, abandoned.

[51] Int. Cl.[2] ..... G03C 7/16; G03C 5/50; G03C 5/30

[52] U.S. Cl. ..... 96/22; 96/59; 96/66 R

[58] Field of Search ..... 96/22, 55, 59, 60 BF, 96/61 M, 66 R

[56] References Cited

PUBLICATIONS

Faul et al.; Method of Producing Rev. Color Images, Research Disclosure 12/74, No. 12839.

*Primary Examiner*—David Klein
*Assistant Examiner*—Louis Falasco
*Attorney, Agent, or Firm*—Carl O. Thomas

[57] ABSTRACT

Reversal color images are produced in silver halide photographic elements which employ a leuco dye comprising the reaction product of a color-forming coupler and an N,N-dialkyl-p-phenylenediamine stabilized against aerial oxidation by an electronegative group attached to the benzene ring. A method is disclosed which comprises developing a silver image in imagewise exposed areas of the silver halide element. The residual silver halide in unexposed areas is then fogged and developed while concurrently oxidizing the leuco dye in these unexposed areas to form a dye image which is a reversal of the imagewise exposure. Developed silver is then removed from the element to leave a dye image without oxidizing the leuco dye in the imagewise exposed areas of the element.

6 Claims, No Drawings

METHOD OF PRODUCING REVERSAL COLOR IMAGES

This is a continuation-in-part of U.S. Ser. No. 487,085, filed July 10, 1974, now abandoned.

FIELD OF INVENTION

This invention relates to photography and more particularly to methods of producing reversal color images employing a light-sensitive silver halide emulsion layer comprising a ballasted leuco dye which is the reaction product of a color-forming coupler and a deactivated N,N-dialkyl-p-phenylenediamine.

BACKGROUND OF INVENTION

In color photography, the dye image is formed during a color developing process. The color developing agent, usually a N,N-dialkyl-p-pheneylenediamine, is oxidized in a reaction with silver halide producing free silver. Oxidized developing agent then reacts rapidly with one or more organic molecules, called couplers, to form dyes. The color of the dye thus formed is determined by the chromophoric structure of the dye contributed by the coupler.

In the preparation of silver halide emulsions for recording colors, it is customary to incorporate a color-forming material in the silver halide emulsion so that upon color development this color-forming compound (coupler) reacts with the oxidation product of the developing agent to form a dye. In a typical emulsion for recording the visible spectrum, the emulsion is coated in several layers, each responsive to a particular region of the spectrum. By suitable control of the development and by use of several couplers, it is possible to form the proper dye in each layer to give an adequate color representation of the light image producing the original exposure, which may be a negative (complement) of the light image or a reversal (positive) of the light image.

Common methods of producing reversal color images include the processes used to develop products, such as those commercially available under the Kodachrome, Ektachrome and Cibachrome trademarks. In processing Kodachrome and Ektachrome products, the color images are produced by first black-and-white developing an exposed photographic element, uniformly exposing or chemically fogging the undeveloped (i.e., residual) silver halide, and finally developing the element in the presence of a color developing agent and a dye-forming coupler. In processing Cibachrome products, the color images are produced by first black-and-white developing a photographic element which already contains the image dyes and then bleaching the dyes in proportion to the developed silver image.

Other methods of producing reversal color images have been described in the prior art. One disclosed in U.S. Pat. No. 3,243,294 relates to a process wherein direct reversal color images are produced by developing an exposed multilayer coupler-incorporated film with a p-phenylenediamine color developing solution in the presence of a black-and-white developing agent and physical development nuclei. In this process, a negative silver image is developed by a black-and-white developing agent which is incorporated in the film. Upon completion of the development of the negative silver image, physical development of the residual silver halide leads to a reversal (i.e., positive) image in color. To obtain the reversal color image, a nucleating agent is required in either the emulsion or the processing solution, and a silver halide solvent is required in the developing solution.

U.S. Pat. No. 3,293,032 and U.S. Pat. No. 3,384,484 describe methods of making positive color images from hydrazones.

U.S. Pat. No. 3,384,484 uses a direct reversal process requiring only a single development step and a bleach-fix step. The direct reversal dye image is formed with certain organic hydrazones that are incorporated in silver halide emulsion layers. In one embodiment, colored hydrazones are used that remain colored in unexposed areas throughout the photographic process, but which are converted into colorless compounds in light-exposed areas during processing. In a second embodiment, a class of colorless hydrazones are used which, during processing, form colorless compounds in light-exposed areas, but in unexposed areas the residual hydrazone is oxidized to a colored dye by a silver bleach step.

Another method is described in U.S. Pat. No. 3,647,452, wherein direct reversal color images are produced by developing an exposed incorporated-coupler (e.g., Ektachrome) film with a p-phenylenediamine color developer in the presence of a competing coupler sufficient to prevent dye formation until the development of the exposed silver is completed. Neither previous black-and-white development (MQ) nor reexposure of the film are necessary. By this method, the film can be processed in a sequence requiring only the two steps of color development and bleach-fixing.

The present invention relates to a novel method capable of producing reversal color images using only black-and-white developing agents. A color development step is unnecessary because a preformed leuco dye is incorporated into the silver halide emulsion. Therefore, the dye molecule does not have to be formed during the development process. The leuco dye need only be oxidized to its corresponding colored form in an imagewise fashion.

OBJECTS OF THE INVENTION

It is therefore an object of this invention to provide a novel method for the production of reversal color images.

It is another object of this invention to provide a novel method for the production of reversal color images in which no conventional color development step is required.

These and other objects are achieved by our invention which is described hereinafter.

SUMMARY OF THE INVENTION

In one aspect, this invention is directed to a method of producing reversal color images which comprises developing a silver image in the imagewise exposed areas of a photosensitive photographic element comprising a support having thereon at least one photosensitive silver halide emulsion layer containing a stabilized ballasted leuco dye which comprises the reaction product of a cyan color-forming coupler and an N,N-dialkyl-p-phenylenediamine having an electronegative group attached to the benzene ring. The electronegative group has the capability of deactivating the p-phenylenediamine group sufficiently to stabilize the leuco dye molecule against aerial oxidation. The residual silver halide is then fogged and developed while concurrently oxidizing the leuco dye to form a dye image. Developed silver is then removed to leave a cyan dye image in the originally unexposed areas of the layer without oxidizing the leuco dye molecules in the imagewise exposed areas of the layer.

In another aspect, this invention is directed to a method of producing reversal color images which comprises:

1. forming a black-and-white image on an imagewise exposed photosensitive photographic element containing silver halide by contacting the exposed element with a non-cross-oxidizing developing composition to thereby develop up the exposed silver halide; the photographic element comprising a support having thereon at least one photosensitive silver halide emulsion layer containing a stabilized ballasted leuco dye which comprises the reaction product of a cyan color-forming coupler and a N,N-dialkyl-p-phenylenediamine having an electronegative group attached to the benzene ring, the electronegative group having the capability of deactivating the p-phenylenediamine group sufficiently to stabilize the leuco dye molecule against aerial oxidation;

2. fogging the residual silver halide in the resulting developed element;

3. treating the fogged element with a cross-oxidizing developing composition to form a cyan dye image in the originally unexposed areas of said layer; and 4. removing developed silver with a mild bleach solution leaving a cyan dye image in the originally unexposed areas of said layer, said mild bleach solution having an oxidizing potential such that it will not oxidize the leuco dye molecules in the originally exposed areas of the layer while the developed silver is being removed.

Other objects and advantages of the invention will become apparent to those skilled in the art of color photography upon consideration of the accompanying disclosure.

DETAILED DESCRIPTION OF THE INVENTION

Stable cyan-dye-forming leuco dyes useful for the practice of the present invention can be represented, for example, by the following formula:

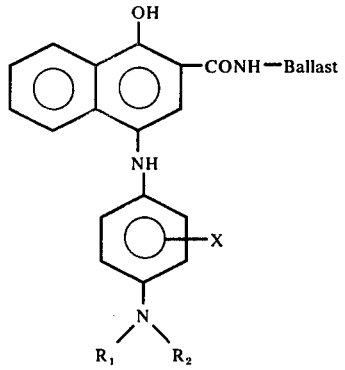

(I)

where

Ballast — represents an organic radical of such molecular size and configuration as to render said leuco dye nondiffusible during development;

$R_1$ and $R_2$ — each represents a lower alkyl group (preferably of 1 to 6 carbon atoms) or a substituted lower alkyl group such as hydroxyalkyl, alkoxyalkyl, carboxyalkyl, sulfoalkyl and haloalkyl; and X — represents at least one electronegative group having the capability of deactivating the p-phenylenediamine group sufficiently to stabilize the leuco dye molecule against aerial oxidation.

An important feature of these novel leuco dyes is the presence of the deactivating group X on the benzene ring of the phenylenediamine portion of the molecule. It is this deactivating group which imparts the stability (i.e., resistance to aerial oxidation) required of these compounds during their storage before and after incorporation in the silver halide emulsion layer of the photographic element.

The deactivating group is an electronegative (i.e., electron withdrawing) group which has sufficient electron withdrawing potential to stabilize the leuco dye against aerial oxidation. Any such group or combination of groups sufficient to stabilize the leuco dye molecule is contemplated. Examples of such electronegative or electron withdrawing groups useful in the practice of the present invention include:

$$-NO_2;\ -CN;\ -CF_3;\ -F;\ -COR^1;\ -COOR^1;$$
$$-SO_2R^1;\ -SO_2R^{11};\ \text{and}\ -CON\begin{matrix}R\\R\end{matrix};$$

wherein R is a hydrogen atom or $R^1$, $R^1$ is a lower alkyl radical or substituted lower alkyl radical, and $R^{11}$ is an aryl radical or a substituted aryl radical (e.g., a substituted or unsubstituted phenyl or naphthyl group).

Other color forming couplers which are useful in forming leuco dyes for the practice of the present invention can be any of the cyan-dye-forming coupler moieties well known to those skilled in the art of color photography. Included among such coupler moieties are the phenolic and naptholic couplers described in the following patents: Porter et al., U.S. Pat. No. 2,295,009 issued Sept. 8, 1942; Salminen et al., U.S. Pat. No. 2,367,531 issued Jan. 16, 1945; Salminen et al., U.S. Pat. No. 2,423,730 issued July 8, 1947; Weissberger et al., U.S. Pat. No. 2,474,293 issued June 28, 1949; Salminen et al., U.S. Pat. No. 2,772,162 issued Nov. 27, 1956; Salminen et al., U.S. Pat. No. 2,895,826 issued July 21, 1959; Bush et al., U.S. Pat. No. 2,920,961 issued Jan. 12, 1960; Vittum et al., U.S. Pat. No. 3,002,836 issued Oct. 3, 1961; Kodak Limited, British Pat. No. 503,752 issued Apr. 11, 1939; Kodak Pathe, French Pat. No. 836,144 issued Jan. 11, 1939; Merckx et al., U.S. Pat. No. 2,197,311 issued Apr. 16, 1940; Fröhlick et al., U.S. Pat. No. 2,357,395 issued Sept. 5, 1944; Thompson, U.S. Pat. No. 2,498,466 issued Feb. 21, 1950; de Ramaix et al., U.S. Pat. No. 3,013,879 issued Dec. 19, 1961; Stecker, U.S. Pat. No. 3,041,236 issued June 26, 1962; de Ramaiz et al., U.S. Pat. No. 3,047,385 issued July 31, 1962; Van Poucke et al., U.S. Pat. No. 3,079,256 issued Feb. 26, 1963; Schulte et al., U.S. Pat. No. 3,244,520 issued Apr. 5, 1966; Kendall et al., British Pat. No. 519,208 issued Mar. 19, 1940; Gevaert Photo-Producten N.V., British Pat. No. 969,921 issued Sept. 16, 1964; Gevaert Photo-Producten N.V., British Pat. No. 975,928 issued Nov. 25, 1965; Agfa Aktiengesellschaft, British Pat. No. 1,011,940 issued Dec. 1, 1965; Societa per Azioni Ferrania, British Pat. No. 1,111,554 issued May 1, 1968; Gevaert Photo-Producten N.V., French Pat. No. 1,299,481 issued June 12, 1962; and Gevaert Photo-Producten N.V., French Pat. No. 1,308,760 issued Oct. 1, 1962. In addition cyan-dye-forming phenolic and naphtholic couplers are described by W. Pelz in an article entitled "FARBKUPPLER-EINE LITERATURE EBERSICHT," published in Agfa Mitteilungen, Band II, pp. 156–175, and are illustrated in Table XXIV on page 595 of "THE THEORY OF THE PHOTOGRAPHIC PROCESS," by C. E. K. Mees — Revised Edition, 1954.

The nature of the ballast group in the formula for the leuco dyes described above (Ballast) is not critical as long as it confers nondiffusibility to the compounds. Typical ballast groups include long-chain alkyl radicals linked directly or indirectly to the compound as well as aromatic radicals of the benzene and naphthalene series indirectly attached or fused directly to the benzene nucleus, etc. Useful ballast groups generally have at least 8 carbon atoms such as a substituted or unsubstituted alkyl group of 8 to 22 carbon atoms, an amide radical having 8 to 30 carbon atoms, a keto radical having 8 to 30 carbon atoms, etc.

The leuco dyes described herein can be prepared according to methods described by T. E. Gompf and W. H. Faul in a copending U.S. Application Ser. No. 487,083 filed July 10, 1974.

Non-cross-oxidizing developing compositions are utilized in the first development step of the process for producing reversal color images described above. During this step, the exposed silver halide is reduced to elemental silver by the non-cross-oxidizing developing composition. The non-cross-oxidizing developing composition, however, will not when oxidized oxidize the leuco dye to its corresponding color dye, so no dye image is formed in this step.

The non-cross-oxidizing compositions useful in the process of this invention are alkaline solutions comprising a non-cross-oxidizing developing agent. Non-cross-oxidizing developing agents are well known and can be any black-and-white developing agent which will reduce exposed silver halide to silver, but will not oxidize the leuco dye in the process. Any such non-cross-oxidizing developing agent is useful in the practice of the present invention. Particularly preferred non-cross-oxidizing agents which exhibit the characteristics described above include ascorbic acid and certain derivatives of pyrimidine such as those described by Wyland and Farley in U.S. Pat. No. 3,672,891 issued on June 27, 1972, which is hereby incorporated by reference. Particularly preferred are 5-amino derivatives of pyrimidine and 5-hydroxy derivatives of pyrimidine, especially 2-methyl-4-amino-5-hydroxypyrimidin-6-one.

Fogging can be accomplished by exposing to light, by chemical fogging or by any conventional means which are well-known to those skilled in the art of photography.

In the second silver developing step, a cross-oxidizing developing composition is used. It is in this step that the dye image is formed. Any silver halide developing composition can be employed in this step of our invention as long as it cross-oxidizes the leuco dye described herein. Such a silver halide developing composition, called a cross-oxidizing developing composition herein, is an alkaline solution comprising a cross-oxidizing black-and-white developing agent. This cross-oxidizing black-and-white developing agent becomes oxidized during development by reducing exposed silver halide to silver metal. The oxidized developer then cross-oxidizes the leuco dye, thereby forming a dye image which contains an amount of dye in inverse proportion to the amount of exposure, i.e., a positive dye image.

A cross-oxidizing black-and-white developing agent (COD) enables a color imaging precursor, such as the leuco dye herein, to become oxidized without the color imaging precursor itself developing silver. It can be viewed as an electron transfer agent which shuttles electrons between the developing silver halide and the color imaging precursor. The general definition can be written schematically as follows:

1. $COD_{Red} + Ag^+ \rightleftharpoons COD_{Ox} + Ag^\circ$

2. $COD_{Ox}$ + Color Imaging $Precursor_{Red} \rightleftharpoons COD_{Red}$ + Color Imaging $Precursor_{Ox}$

* Subscript "Red" denotes reduced form and "Ox" denotes oxidized form.

The color imaging precursor is any chemical compound which, when oxidized, becomes a material which differs from the precursor in some way (absorption, chemistry, etc.) that can be exploited for imaging.

The color imaging precursor is frequently immobilized in an oil phase, and so a more specific scheme for the formation of a cross-oxidizing developing agent is as follows:

3. $COD_{Red}\,(H_2O) + Ag^+ \rightleftharpoons COD_{Ox}\,(H_2O) + Ag^\circ$

4. $COD_{Ox}\,(H_2O) \rightleftharpoons COD_{ox}\,(Oil)$

5. $COD_{Ox}$ (Oil) + Color Imaging $Precursor_{Red}$ (Oil) $\rightleftharpoons COD_{Red}$ (Oil) + Color Imaging $Precursor_{Ox}$ (Oil)

6. $COD_{Red}\,(Oil) \rightleftharpoons COD_{Red}\,(H_2O)$

Therefore, the characteristics of a cross-oxidizing developing agent in the most general cases (e.g., 1 and 2) are:

a. It has sufficient electrochemical potential under the experimental conditions to develop exposed silver halide.
b. In its oxidized form, it is of such electrochemical potential as to oxidize the color imaging precursor.
c. In its oxidized form, it is stable to decomposition by other chemical reactions long enough to undergo the redox reaction with the color imaging precursor.

A further characteristic of the specific system represented by equations 3–6 are:

d. The oxidized form has high solubility in any oil phase such as coupler solvent in the photographic element, since extensive partitioning into the oil phase is often required.

It should be recognized that whether a particular developing agent meets the requirements of a cross-oxidizing developing agent as described above may depend upon the conditions under which development occurs. Other components in the developing composition, the pH of the developing compositions, the temperature of the development process, the length of development time, etc. can all affect whether the requirements for a cross-oxidizing developing agent are met. It can be further noted that because of the conditions required for cross-oxidation a particular developing agent may act as a non-cross-oxidizing agent or as a cross-oxidizing agent depending upon the composition of the developing solution and on the conditions under which development occurs. Both the cross-oxidizing and non-cross-oxidizing developing agents have been referred to in the prior art as black-and-white developing agents.

The selection of specific cross-oxidizing and non-cross-oxidizing silver halide developer compositions for use in the practice of this invention will be readily apparent to anyone having ordinary skill in the art. For example, a large number of black-and-white developing agents have been disclosed in the art incorporated in color developer compositions for the purpose of cross-oxidizing color developing agents which are also present. Such cross-oxidizing silver halide developer compositions and conditions for their use are disclosed, for example, in Gompf et al., U.S. Pat. No. 3,698,987, issued Oct. 17, 1972; Anderson et al., U.S. Pat. No. 3,725,062, issued Apr. 3, 1973; Becker et al., U.S. Pat. No. 3,728,113, issued Apr. 17, 1973; and Figueras et al., U.S. Pat. No. 3,734,726, issued May 22, 1973.

It is recognized that a particular black-and-white developing agent can be either cross-oxidizing or non-cross-oxidizing in developer compositions differing solely in their pH values. The selection of useful non-cross-oxidizing developer compositions is then quite simple, since it is known that all cross-oxidizing silver halide developing agents cease to be cross-oxidizing at lower pH values, although the particular pH value at which a specific developing agent ceases to cross-oxidize varies from one developing agent to another. The proper pH for a developer composition employed in the first step of this invention can be readily determined merely by developing a sample of an exposed photographic element containing a silver halide emulsion layer and associated therewith a leuco dye of the type defined above. If a dye is observed in the developer composition or in the photographic element being processed, another quantity of developer composition can be made up differing by having a somewhat lower pH and a second sample can be processed therein. If a dye is again observed, the above procedure can be repeated until a pH is reached at which development of the sample ceases to produce observable dye.

Developing agents which meet the requirements of a cross-oxidizing developing agent under development conditions can be used within the scope of this invention. Illustrative examples of developing agents which may be useful as cross-oxidizing developing agents in practicing this invention and also preferred cross-oxidizing agents are 1-phenyl-3-pyrazolidone (Phenidone), 1-phenyl-4,4-dimethyl-3-pyrazolidone (Dimezone), and 4-hydroxymethyl-4-methyl-1-phenyl-3-pyrazolidone.

An important feature of the processing cycle by which image dyes are produced from the leuco dyes described above is the removal from the photographic element of the developed silver and any residual silver halide in such a way that the leuco dyes will not be oxidized in the areas of the photographic element where they are to remain colorless (i.e. the originally exposed area in the reversal process described herein). Since the potent oxidizing capability of a conventional solution of a bleach such as potassium ferricyanide or ferric chloride could, by oxidation to visible dye, convert the leuco dye molecules in the areas already developed by the non-cross-oxidizing development step to visible dye, a ferricyanide or ferric chloride bleach followed by a fix is not preferred. The relatively mild oxidizing medium of conventional bleach-fix solutions, however, will not detrimentally affect the leuco dyes in the areas of the photographic element where they are to remain colorless. Useful bleach solutions are those having an oxidizing potential such that they will not oxidize the leuco dye in the unexposed or partially exposed areas of the element. It is preferred, however, to use a single bleach-fix bath in the processing cycle since generally the bleach-fix solution provides a mild oxidizing medium suitable for the practice of this invention. Suitable bleach-fix baths include, for example, solutions of sodium or ammonium thiosulfate with complexes of trivalent iron and ethylenediamine tetraacetic acid (EDTA).

The silver halide emulsions useful in our invention are well-known to those skilled in the art and are described in *Product Licensing Index*, Vol. 92, December, 1971, publication 9232, p. 107, paragraph I, "Emulsion types"; they may be chemically and spectrally sensitized as described on p. 107, paragraph III, "Chemical sensitization", and pp. 108–109, paragraph XV, "Spectral sensitization", of the above article; they can be protected against the production of fog and can be stabilized against loss of sensitivity during keeping by employing the materials described on p. 107, paragraph V, "Antifoggants and stabilizers", of the above article; they can contain development modifiers, hardeners, and coating aids as described on pp. 107–108, paragraph IV, "Development modifiers"; paragraph VII, "Hardeners"; and paragraph XII, "Coating aids", of the article, they and other layers in the photographic elements used in this invention can contain plasticizers, vehicles and filter dyes described on p. 108, paragraph XI, "Plasticizers and lubricants", and paragraph VIII, "Vehicles", and p. 109, paragraph XVI, "Absorbing and filter dyes", of the above article; they and other layers in the photographic elements used in this invention may contain addenda which are incorporated by using the procedures described on p. 109, paragraph XVII, "Methods of addition", of the above article; and they can be coated by using the various techniques described on p. 109, paragraph XVIII, "Coating procedures", of the above article; the disclosures of which are hereby incorporated by reference.

The following examples further illustrate the invention.

EXAMPLE 1

A sample of a supported single-layer gelatinous silver halide coating containing per square foot of coating 108 mg silver, 500 mg gelatin, and 170 mg of Leuco Dye I* dissolved in 170 mg of di-(2-ethylhexoate)-1,4-cyclohexanediol was exposed for 1/5 second to a graduated-density test object and then processed in the following sequence:

| | | |
|---|---|---|
| 1. | Black-and-white development** | 5 min. |
| 2. | Wash | 30 sec. |
| 3. | Flash Exposure | |
| 4. | Reversal Development*** 5 | min. |
| 5. | Stop-Fix (F-5) | 5 min. |
| 6. | Wash | 5 min |
| 7. | Bleach-fix**** | 5 min. |
| 8. | Wash | 5 min. |
| 9. | Drying | |

where:

** Black-and-white Developer Solution consists of 5.0 g of an amino pyrimidine developing agent (non-cross-oxidizing developing agent) in one liter of phosphate buffer (pH 12.0).

*** Reversal Developer Solution consists of 0.2 g of 4-hydroxymethyl-4-methyl-1-phenyl-3-pyrazolidone (cross-oxidizing developing agent) in one liter of phosphate buffer (pH 12.0).

**** Bleach-Fix Solution consists of:

NH FeEDTA 90 ml of 1.56 molar solution

-continued

| | |
|---|---|
| $(NH_4)_2S_2O_3$ | 125 ml of 60% solution |
| $Na_2SO_3$ | 12 g |
| $H_2O$ to 1 Liter | |
| (pH 6.5–6.8) | |

*Leuco Dye I was

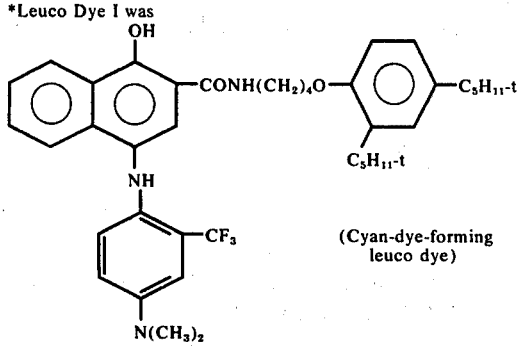

(Cyan-dye-forming leuco dye)

A positive cyan dye image was formed.

EXAMPLE 2

The procedure described in Example 1 was repeated except Kodak DK-50 black-and-white developer was used as the non-cross-oxidizing developer instead of the pyrimidine developing solution described in Example 1.

EXAMPLE 3

The procedure of Example 1 was repeated except Leuco Dye II* was used in the silver halide coating and Kodak DK-50 black-and-white developer was used as the non-cross-oxidizing developer for developing times of 10 minutes or 15 minutes. All other procuring steps were the same as Example 1.

*Leuco Dye II was

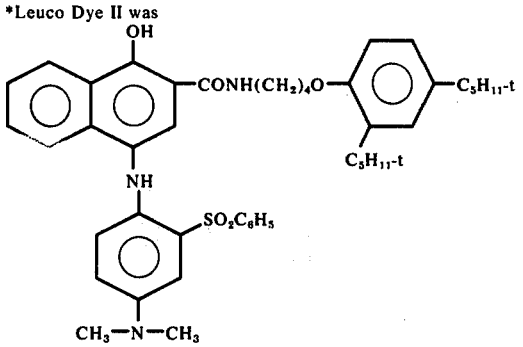

Examples 1–3 showed the excellent stability of the leuco dye before and during processing and the useable dye images formed by reversal processing in accordance with the teachings of this invention. Note particularly that a low minimum density (Dmin approximately 0.1) and a good maximum density (Dmax 2.40) was produced from the leuco dye under the above-described processing conditions of Example 3.

EXAMPLE 4

The processed sample of Example 2 was then subjected to a 5-day heat fading test (140° F/70% RH). This minimum (Dmin) and maximum (Dmax) densities of the cyan image (read through a Status A red filter) were recorded in the table below.

Table

| Keeping Time | Dmin | Dmax |
|---|---|---|
| 0 Day | 0.32 | 2.50 |
| 1 Day | 0.38 | 2.44 |
| 5 Days | 0.50 | 2.40 |

The results of the above-described fading test showed excellent stability of the leuco dye.

The invention has been described with particular reference to certain preferred embodiments thereof, but it will be understood that variations and modifications can be effected within the spirit and scope of the invention.

We claim:

1. A method of producing reversal color images which comprises:

1. forming a silver image in the imagewise exposed areas of a photosensitive photographic element comprising a support having thereon at least one photosensitive silver halide emulsion layer containing a stabilized ballasted leuco dye which comprises the reaction product of a cyan color-forming coupler and an N,N-dialkyl-p-phenylenediamine having an electronegative group attached to the benzene ring, said electronegative group having the capability of deactivating the p-phenylenediamine group sufficiently to stabilize the leuco dye molecule against aerial oxidation by contacting said exposed element with a developing composition containing a developing agent selected from the group consisting of ascorbic acid, 5-amino derivatives of pyrimidine and 5-hydroxy derivatives of pyrimidine;
2. fogging the residual silver halide in said layer;
3. developing the residual silver halide in the fogged element and concurrently oxidizing the leuco dye to form a dye image with a developing composition containing a developing agent selected from the group consisting of 1-phenyl-3-pyrazolidone, 1-phenyl-4,4-dimethyl-3-pyrazolidone and 4-hydroxymethyl-4-methyl-1-phenyl-3-pyrazolidone; and,
4. removing developed silver to leave a cyan dye image in the originally unexposed areas of said layer without oxidizing the leuco dye molecules in the imagewise exposed areas of said layer.

2. The method of claim 1 wherein the step of removing developed silver comprises using a bleach-fix solution to remove said developed silver.

3. The method of claim 1 wherein the stabilized ballasted leuco dye is of the formula:

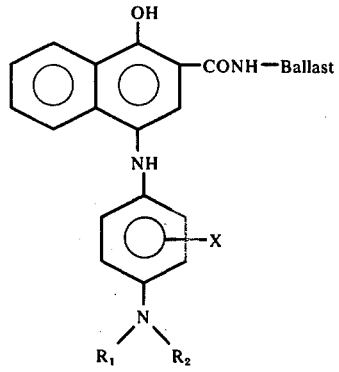

where

Ballast — represents an organic radical of such molecular size and configuration as to render said leuco dye nondiffusible during storage and development;

$R_1$ and $R_2$ — each represent a lower alkyl group or a substituted lower alkyl group; and X — represents at least one electronegative group having the capability of deactivating the p-phenylenediamine group sufficiently to stabilize the leuco dye molecule against aerial oxidiation.

4. The method of claim 1 wherein the stabilized ballasted leuco dye is of the formula:

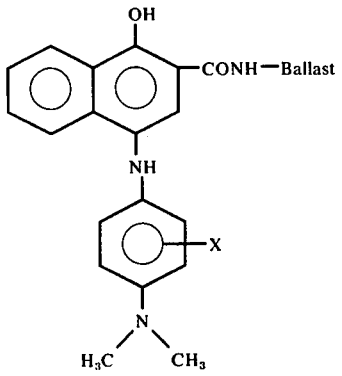

where

Ballast — represents an organic radical of such molecular size and configuration as to render said leuco dye nondiffusible during storage and development; and X — is selected from the group consisting of $-CF_3$, $-SO_2C_6H_5$, and $-CONH_2$.

5. The method of claim 1 wherein the stabilized ballasted leuco dye is of the formula:

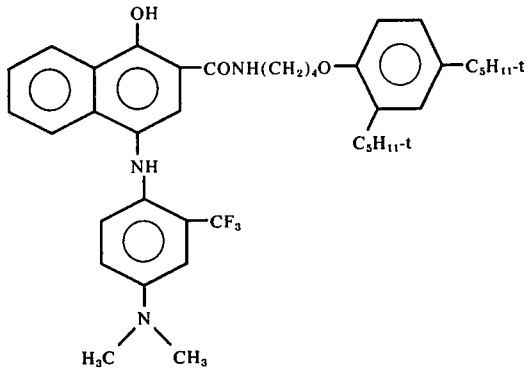

6. The method of claim 1 wherein the stabilized ballasted leuco dye is of the formula:

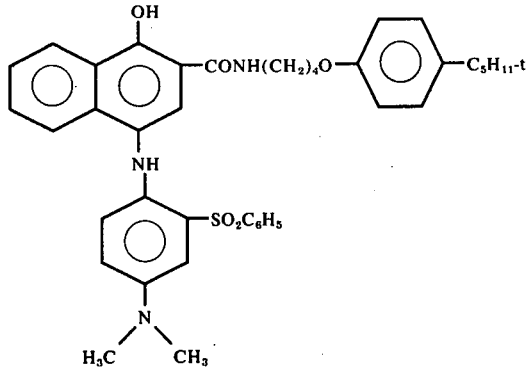

* * * * *